United States Patent [19]

Elmore

[11] 4,278,119

[45] Jul. 14, 1981

[54] STORAGE MEANS FOR REMOVABLE TIPS FOR HAND TOOL

[75] Inventor: Charles E. Elmore, Clarkson, Ky.

[73] Assignee: Vermont American Corporation, Louisville, Ky.

[21] Appl. No.: 109,831

[22] Filed: Jan. 7, 1980

[51] Int. Cl.[3] ..... B25G 1/08

[52] U.S. Cl. ..... 145/62

[58] Field of Search ..... 145/62, 63

[56] References Cited

U.S. PATENT DOCUMENTS

| | | | |
|---|---|---|---|
| 685,678 | 10/1901 | Furbish | 145/62 |
| 2,337,514 | 12/1943 | Wilcox | 145/62 |
| 3,006,395 | 10/1961 | Dye | 145/63 |

FOREIGN PATENT DOCUMENTS

| | | | |
|---|---|---|---|
| 396874 | 8/1933 | United Kingdom | 145/62 |

*Primary Examiner*—James L. Jones, Jr.
*Assistant Examiner*—J. T. Zatarga
*Attorney, Agent, or Firm*—Harry B. O'Donnell, III

[57] ABSTRACT

This invention provides a hand tool of the type including a shaft having on one of its two opposite ends a handle and on the other of its two opposite ends socket means for selectively receiving and holding a removable tool tip with improved means to be used in combination with it for storing a plurality of removable tool tips. Basically, the novel tool tip storage means comprises a generally cylindrical storage member having a bore along its long central axis that is mounted on the tool shaft for slideable movement between the tool handle and socket means. The storage member also has a first surface that faces the socket means and is engaged by yieldable means that encircles the tool shaft and extends between and is compressed between said first surface and the socket means. The storage member further has a second surface opposite from its first surface that is provided with openings into a plurality of chambers which are radially and angularly spaced apart around its central bore and are aligned generally parallel to the long central axis of the tool shaft. The chambers each have a width and depth sufficient to slideably receive and store any tool tip intended to be removably received and held by the socket means. The chambers each extend toward the first surface of the storage member from one of the openings in the second surface thereof, with that second surface being yieldably urged away from the socket means and into engagement with a generally complementary surface of the tool handle by the yieldable means. Preferably, the yieldable means comprises spring means and the width of the storage member is less than that of the tool handle. It is also desirable that one of the chambers of the storage member be provided between the first and second surfaces thereof with an inspection port extending through a radially outer wall thereof of a size sufficient to permit a partial view of the tool tip stored therein but insufficient to allow the removal of the tip therethrough.

7 Claims, 5 Drawing Figures

STORAGE MEANS FOR REMOVABLE TIPS FOR HAND TOOL

BACKGROUND OF THE INVENTION

This invention relates to a hand tool of the type including a shaft having on one of its two opposite ends a handle and on the other of its two opposite ends socket means for selectively receiving and holding a removable tool tip and, more particularly, to novel and improved means that can be used in combination with such a hand tool for storing on it a plurality of removable tool tips.

Many different forms of hand tools of the aforedescribed type have been constructed and widely distributed in the past which have a plurality of diverse tool tips that can be removably kept within storage means that are integrally formed with the tool handle. Typical ones of these old forms are shown and described in detail in U.S. Pat. Nos. 152,228 (Henry), 509,851 (Britton), 516,294 (Britton), 685,678 (Furbish), 1,904,679 (Fegley et al), 1,937,645 (Fegley et al), and 3,683,984 (Hull). Thus, with these prior-art forms of such hand tools, it has been essential to provide the hand tool with a handle of "special" construction.

In accordance with the present invention, there is provided novel and improved means that can be readily adapted for use in combination with most otherwise conventional hand tools of the aforedescribed type for storing on such a tool a plurality of removable tool tips without the need for providing the tool with any such specially constructed handle.

SUMMARY OF THE INVENTION

The present invention provides a hand tool of the type including a shaft having on one of its two opposite ends a handle and on the other of its two opposite ends socket means for selectively receiving and holding a removable tool tip with improved means to be used in combination with it for storing a plurality of removable tool tips.

Basically, the novel tool tip storage means comprises a generally cylindrical storage member having a bore along its long central axis that is mounted on the tool shaft for slideable movement between the tool handle and socket means. The storage member also has a first surface that faces the socket means and is engaged by yieldable means that encircles the tool shaft and extends between and is compressed between the first surface it and the socket means. The storage member further has a second surface opposite from its first surface that is provided with openings into a plurality of chambers which are radially and angularly spaced apart around its central bore and are aligned generally parallel to the long central axis of the tool shaft. The chambers each have a width and depth sufficient to slideably receive and store any tool tip intended to be removably received and held by the socket means. The chambers each extend toward the first surface of the storage member from one of the openings in the second surface thereof, with that second surface being yieldably urged away from the socket means and into engagement with a generally complementary surface of the tool handle by the yieldable means.

Preferably, the yieldable means comprises spring means and the width of the storage member is less than that of the tool handle.

It is also desirable that one of the chambers of the storage member be provided between the first and second surfaces thereof with an inspection port extending through a radially outer wall thereof of a size sufficient to permit a partial view of the tool tip stored therein but insufficient to allow the removal of the tip therethrough.

BRIEF DESCRIPTION OF THE DRAWINGS

The present invention is illustrated in the accompanying drawings, wherein.

DETAILED DESCRIPTION

Figure 1:
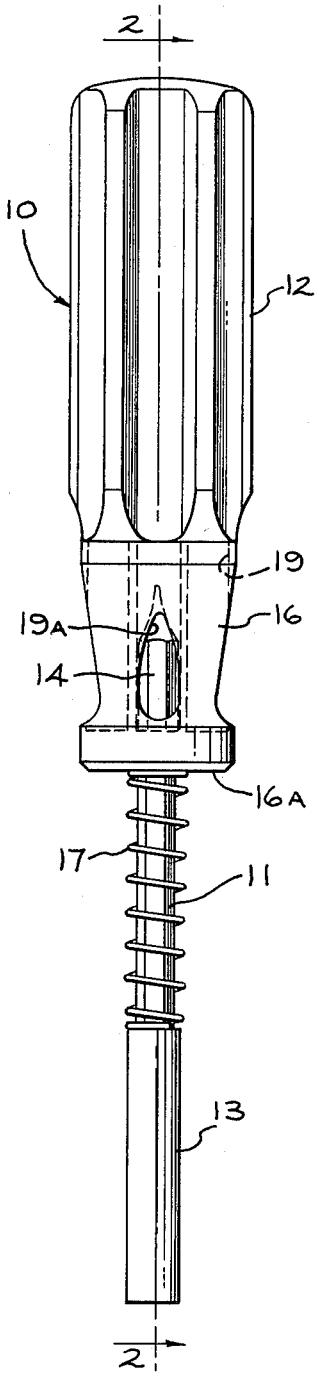
FIG. 1 is a somewhat schematic elevational view of an otherwise conventional form of a hand tool of the aforedescribed type in combination with a presently preferred form of the novel and improved means provided in accordance with the present invention for storing on it a plurality of removable tool tips and showing the same in its tool tip storage condition.
Figure 2:
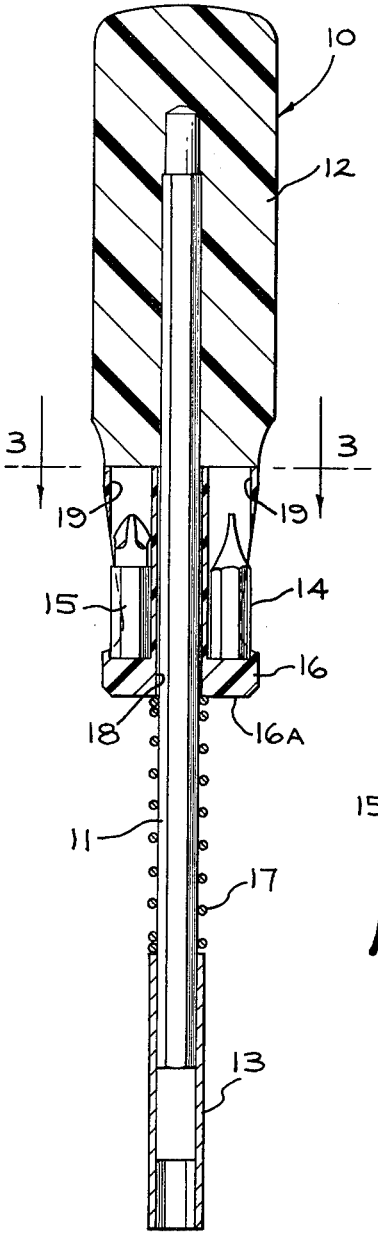
FIG. 2 is a sectional view taken generally along line 2—2 of FIG. 1.
Figure 3:
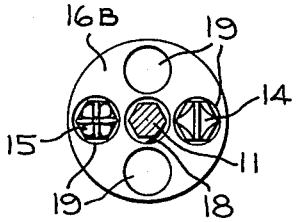
FIG. 3 is a sectional view taken along line 3—3 of FIG. 2.

Turning now to the drawings and, more particularly, to FIGS. 1–5 thereof, there is illustrated a hand tool 10 including a shaft 11 having affixed on one of its two opposite ends a handle 12 and on the other of its two opposite ends socket means 13 for selectively receiving and holding a removable tip, such as a "standard" screwdriver tip 14 or a "Phillips-head" screwdriver tip 15.

With the exception of the unique construction of the presently preferred form of the novel and improved tip storage means that are illustrated in combination with it and basically include storage member 16 and yieldable means 17, and which will be discussed in detail hereinafter, the hand tool 10 is otherwise generally conventional, being, in fact, a screwdriver that is intended to selectively receive and hold within the distal end of its socket means 13 the shank of either of the two illustrated tool tips 14 or 15, as well as other alternative shapes of tool tips (not shown).

As illustrated in the drawings, the novel tip storage means of the present invention basically include the storage member 16, which is a generally cylindrical member having a bore 18 along its long central axis that is mounted on the tool shaft 11 for slideable movement between the tool handle 12 and socket means 13, and the yieldable means 17, which, preferably, comprise a spring that encircles the tool shaft 11 and extends fully between and is compressed between the tool socket means 13 and the storage member 16. The storage member 16 has a first surface 16A that faces the socket means 13 and is engaged by the yieldable means 17 that is located between it and the socket means 13 when its central bore 18 is thus mounted on the tool shaft 11.

As also shown in the drawings, the storage member 16 further has a second surface 16B opposite from its first surface 16A that is provided with openings into a plurality of chambers 19—four such chambers 19 are shown in the illustrated embodiment—which are radially and angularly spaced around its central bore 18 and are aligned generally parallel to the long central axis of the tool shaft 11 when that bore 18 is mounted thereupon. The chambers 19 each have a width and depth sufficient to slideably, wholly receive and store any tool tips, such as the tool tips 14 and 15, intended to be removably received and held by the tool socket means 13. These tips storage chambers 19 each extend toward the first surface 16A of the storage member 16 from one of the openings in the second surface 16B thereof, with that second surface 16B being yieldably urged away from the socket means 13 and into engagement with a generally complementary surface 12C of the tool handle 12 by the yieldable spring means 17 and into the tool tip storage condition, as shown in drawing FIGS. 1 and 2.

As further shown in the drawings, it is also desirable that the width of the storage member 16 be less than that of the tool handle 12 and that each one of the chambers 19 of the storage member 16 be provided between the first 16A and second 16B surfaces thereof with an inspection port 19A extending through a radially outer wall thereof that is of a size sufficient to permit a partial view of the tool tip, such as the tool tips 14 and 15, stored therein but insufficient to allow removal of the tool tip therethrough.

Figure 4:
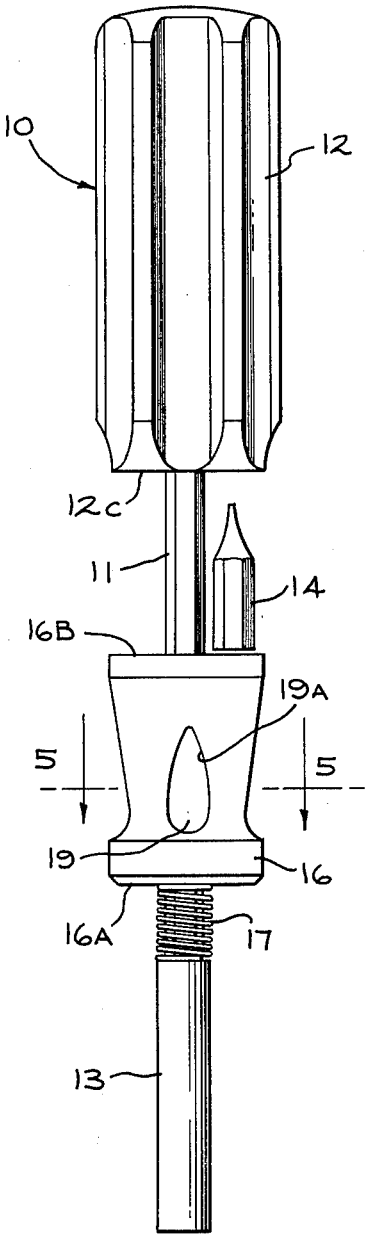
FIG. 4 is a view similar to FIG. 1 but showing the stored tool tip-removal condition.
Figure 5:
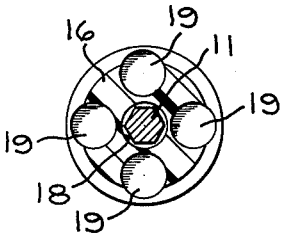
FIG. 5 is a sectional view taken along line 5—5 of FIG. 4.

As best shown in drawing FIG. 4, in order to insert or withdraw one of the tool tips, such as the illustrated tool tip 14, the storage member 16 is manually slideably moved along the tool shaft 11 towards the socket means 13 to overcome the pressure of the yieldable spring means 17 and space its second surface 16B apart from the complementary surface 12C of the tool handle 12 sufficiently to permit the insertion or withdrawal of one of the tips, such as the tip 14, into or out of one of the chambers 19 of the storage member 16.

Preferably, as shown, the tool tip to be stored therein is inserted shank-first into the chosen one of the chambers 19 of the storage member 16. Once the manual movement of the storage member 16 against the yieldable spring means 17 is ceased, its second surface 16B will then be returned into engagement with the complementary surface 12C of the handle 12 and retained thereby, as shown in drawing FIGS. 1 and 2.

Of course, it should be understood, that upon removal from the storage chamber 19, the shank end of the tool tip 14 is inserted into the distal end of the tool socket means 13 where it is received and held in a well-known manner (not shown) and its distal end can then be inserted into the head of a standard screw to drive or withdraw the same through manual operation of the handle 12 of the tool 10.

It should be apparent that while there has been described what is presently considered to be a presently preferred form of the present invention in accordance with the Patent Statutes, changes may be made in the disclosed device without departing from the true spirit and scope of this invention. It is, therefore, intended that the appended claims shall cover such modifications and applications that may not depart from the true spirit and scope of the present invention.

What is claimed is:

1. In combination with a hand tool including a shaft having on one of its two opposite ends a handle and on the other of its two opposite ends socket means for selectively receiving and holding a removable tool tip, improved means for storing a plurality of removable tool tips, comprising:

(a) a generally cylindrical storage member having a bore along its long central axis that is mounted on the tool shaft for slideable movement between the tool handle and socket means, (b) said storage member also having a first surface that faces said socket means and is engaged by yieldable means that encircles the tool shaft and extends between and is compressed between said first surface and the socket means, (c) said storage member further having a second surface opposite from said first surface that is provided with openings into a plurality of chambers which are radially and angularly spaced apart around said bore and are aligned generally parallel to the long central axis of the tool shaft, (d) said chambers each having a width and depth sufficient to slideably receive and store any tool tip intended to be removably received and held by the socket means, and (e) said chambers each extending toward said first surface of said storage member from one of said openings in said second surface thereof, with said second surface being yieldably urged away from the socket means and into engagement with a generally complementary surface of the tool handle by said yieldable means.

2. The invention of claim 1, wherein said yieldable means comprises spring means.

3. The invention of claim 2, wherein the width of said storage member is less than that of the tool handle.

4. The invention of claim 3, wherein one of said chambers of said storage member is provided between said first and second surfaces thereof with an inspection port extending through a radially outer wall thereof of a size sufficient to permit a partial view of the tool tip stored therein but insufficient to allow the removal of the tip therethrough.

5. The invention of claim 1, wherein the width of said storage member is less than that of the tool handle.

6. The invention of claim 5, wherein one of said chambers of said storage member is provided between said first and second surfaces thereof with an inspection port extending through a radially outer wall thereof of a size sufficient to permit a partial view of the tool tip stored therein but insufficient to allow the removal of the tip therethrough.

7. The invention of claim 1, wherein one of said chambers of said storage member is provided between said first and second surfaces thereof with an inspection port extending through a radially outer wall thereof of a size sufficient to permit a partial view of the tool tip stored therein but insufficient to allow the removal of the tip therethrough.

* * * * *